United States Patent [19]

Gressett, Jr.

[11] Patent Number: 4,656,916

[45] Date of Patent: Apr. 14, 1987

[54] TREMOLO SPRING ADJUSTMENT MECHANISM FOR ELECTRIC GUITARS

[76] Inventor: Charles A. Gressett, Jr., 808 W. Lime St., Brea, Calif. 92621

[21] Appl. No.: 697,219

[22] Filed: Jan. 31, 1985

[51] Int. Cl.[4] ..... G10D 3/00

[52] U.S. Cl. ..... 84/313

[58] Field of Search ..... 84/313, 422 S

[56] References Cited

U.S. PATENT DOCUMENTS

| | | | |
|---|---|---|---|
| D. 203,879 | 2/1966 | Burns | 84/313 X |
| 519,914 | 5/1894 | Koeth | 84/422 S |
| 2,741,146 | 4/1956 | Fender | 84/313 |
| 2,972,923 | 2/1961 | Fender | 84/313 |
| 3,181,409 | 5/1965 | Burns et al. | 84/313 |
| 4,106,387 | 8/1978 | Alifano | 84/312 P |
| 4,137,812 | 2/1979 | Franzmann | 84/313 |
| 4,157,050 | 6/1979 | Lashley | 84/312 P |
| 4,354,417 | 10/1982 | Glaser, II | 84/312 R |
| 4,383,466 | 5/1983 | Shibuya | 84/313 |
| 4,475,432 | 10/1984 | Stroh | 84/314 N |
| 4,512,232 | 4/1985 | Schaller | 84/313 |

FOREIGN PATENT DOCUMENTS 1280026 10/1968 Fed. Rep. of Germany ..... 84/313

*Primary Examiner*—Lawrence R. Franklin

*Attorney, Agent, or Firm*—Gausewitz, Carr & Rothenberg

[57] ABSTRACT

A guitar body is provided having a bridge plate pivotally mounted thereon, for example, by knife elements. Thus, when the bridge plate is pivoted in response to operation of a tremolo arm there will be a tremolo action in the guitar strings. The guitar body has a recess therein, which contains springs extending generally longitudinally of the guitar strings. One end of each spring is connected to the bridge plate, while the other end is connected to a yoke that is rotatably associated with a shaft extending generally longitudinally of the guitar strings. The shaft extends through the guitar body to one end thereof, so that it can be rotated in response to operation of a wrench. Upon turning of the wrench, the yoke moves along the shaft to adjust the spring tension of springs and thus the resistance to pivotal movement of the bridge plate.

15 Claims, 2 Drawing Figures

TREMOLO SPRING ADJUSTMENT MECHANISM FOR ELECTRIC GUITARS

BACKGROUND OF THE INVENTION

Various prior-art patents have described ways of changing the force of the spring means in the tremolo apparatus of an electric guitar. All have been deficient in various ways, including one or more of the following: lack of sufficient range of spring-tension adjustment, and difficulty of awkwardness of access to the adjustment means.

After expensive attempts to solve the stated problems in other ways, which attempts included a widely-marketed apparatus that was not satisfactory vis-a-vis spring-tension adjustment, applicant has solved the above-specified problems, and done so in a manner that is simple, rugged, practical, economical, and commercial.

SUMMARY OF THE INVENTION

In accordance with the present invention, a long threaded shaft is mounted in the guitar body and oriented generally longitudinally of the strings. The shaft extends beneath the tremolo lever, from the tail of the guitar to a location far closer to the guitar head than is the tremolo lever. Bearing means are provided for the shaft, which is readily rotated by a wrench or other device located at the tail of the guitar.

Threadedly mounted on the shaft, between the tremolo lever and the inner end of the neck of the guitar, is a yoke or block. The yoke is connected by two tension springs to different portions of the tremolo lever, such portions being so located as to maintain the tremolo lever in well-balanced and assembled relationship relative to its fulcrum means. The tendency of the yoke to rotate when the shaft is turned is prevented by an inner surface of the bottom wall of the guitar body.

DETAILED DESCRIPTION OF THE PREFERRED EMBODIMENT

The preferred tremolo mechanism is described in patent application Ser. No. 697,221, filed on even date herewith, for a "Tremolo Bridge for Guitars", inventors Gressett, Page, Smith and Carruthers. Said patent application is hereby incorporated by reference herein.

The entire guitar, not shown, is of a conventional type having a wooden body, a neck projecting from the body, a head at the outer end of the neck and on which are tuning screws, and a nut at the junction region between the head and neck on the same side as the fretted fingerboard. A classic guitar body having a tremolo mechanism is shown by Fender U.S. Pat. No. 2,741,146, which is hereby incorporated by reference herein. A neck is shown in U.S. Pat. No. 4,206,679 which is hereby incorporated by reference herein. Preferably, the nut of the guitar is of a clamping type, a preferred form of which is described in patent application Ser. No. 697,220, filed on even date herewith for "Clamping Nut and Method", inventors Gressett and Page. Said application is hereby incorporated by reference herein.

The present guitar body is numbered 10, such body being shown with the tail 11 at the right ends of the drawings. The top of the body 10 is routed-out to form a relatively large recess 12 in which there are lands for support of various elements as described below.

Figure 2:
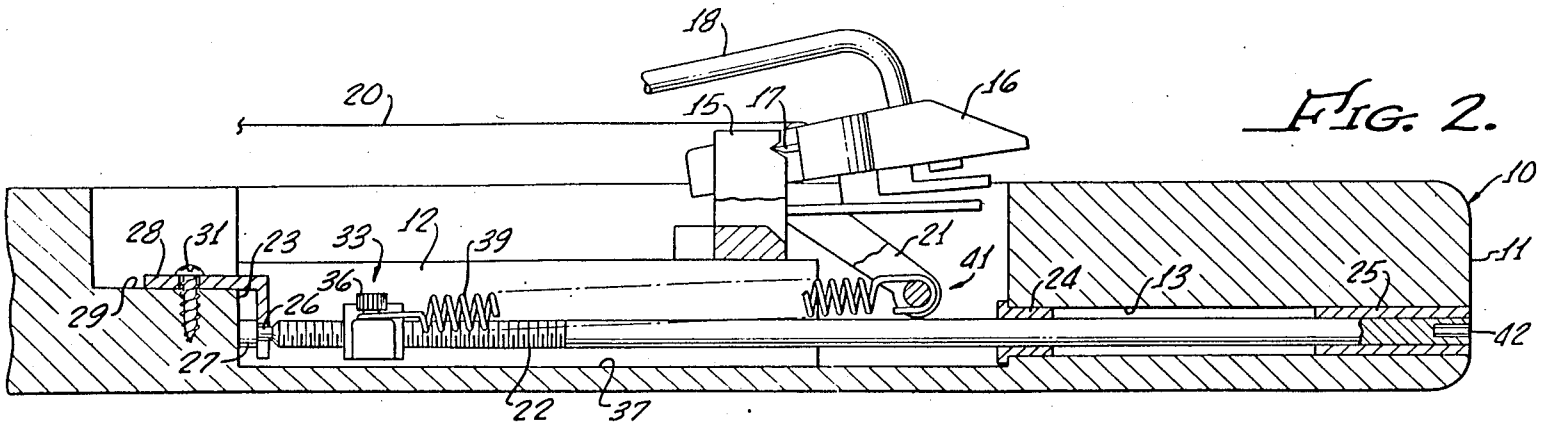
FIG. 2 is a longitudinal vertical sectional view taken generally on the center line of the guitar body.

A bore 13 is drilled through body 10 between recess 12 and tail 11, as best shown in FIG. 2, such bore preferably extending substantially parallel to the bottom surface of body 10 and parallel to the strings.

The tremolo apparatus includes pivot or fulcrum means in the form of pivot blocks 15 that are anchored on lands in body 10 by anchor means, not shown. The pivot blocks are disposed on opposite sides of a bridge plate 16 that is disposed generally above the upper surface of body 10, the illustrated bridge plate nesting forwardly between the two pivot blocks 15. In the preferred bridge, the bridge plate has two knife elements 17 that fit tiltably in horizontal grooves in the pivot blocks, thus providing a low-friction pivotal relationship.

Pivoting of the bridge plate 16 is effected by means of a tremolo arm 18 which is, very preferably, of the snap-out type described in U.S. patent application Ser. No. 689,715, filed Jan. 4, 1985, inventors Page and Schaller, now Pat. No. 4,604,936, issued Aug. 12, 1986. Said patent is hereby incorporated by reference herein. Adjustable bridge assemblies 19 are mounted on the bridge plate 16, and the guitar strings are extended from the bridge plate and bridge assemblies over the body and neck of the guitar and thence over the nut to the tuning screws of the head. One such string is shown at 20 in FIG. 2.

The bridge plate 16 has two arms or cranks 21 fixedly connected thereto, and extending downwardly therefrom to the lower portion of recess 12. There are two such arms 21, one on each side of the vertical central plane containing the longitudinal axis of the guitar body. Preferably, the arms 21 and associated springs are mirror images of each other relative to such vertical central plane.

A long shaft 22 is extended through bore 13 and clear to the forward wall 23 of recess 12. Shaft 22 passes beneath bridge plate 16, extending from the tail of the guitar to a position far closer to the guitar head than is the bridge plate. The shaft portion in the bore 13 is preferably unthreaded, as illustrated, and rotates in bushings or sleeves 24 and 25. Sleeve 24 is shown as being relatively short, having a flange at the inner end thereof to limit the degree of penetration into bore 13. The illustrated sleeve 25 is much longer, being at the outer end of the bore (adjacent the tail 11), and is press-fit, glued or otherwise suitably secured in the bore. The elements 24 and 25 permit free rotation of the shaft 22 when desired by the guitarist.

At its forward end, shaft 22 is necked-down to form a neck 26. An enlarged head 27 is provided on shaft 22 forwardly (toward the head of the guitar) adjacent neck 26 and also adjacent recess wall 23. A combination thrust bearing and hold-down bracket 28 is provided at land 29 in the guitar body 10. Element 28 is an angle bracket having a horizontal portion secured by a screw 31 to the guitar body, at the land, and also having a vertical portion that bends downwardly and terminates at a bifurcated or forked lower end. Such forked lower end seats around neck 26, and is sufficiently small that the head 27 may not pass between the two prongs of the fork.

Accordingly, the forward surface of the vertical portion of bracket 28 serves as a thrust bearing that absorbs the thrust exerted by the springs next described.

A yoke or block 33 is provided, having an internally-threaded central portion 34 that is mated with the threads of rod 22. The yoke or block also has horizontally-outwardly extending portions that provide anchor regions for the springs. Stated more definitely, screws 36 are threaded vertically downwardly into the outer portions of yoke 33, the screw heads being spaced sufficiently far from the upper surfaces of such outer portions that hooked ends of the springs may extend therearound and be held against vertical movement.

The underside of yoke or block 33 is adjacent the horizontal bottom wall 37 of the recess 12, that is to say, is adjacent the bottom portion of the guitar body. Thus, wall 37 insures against rotation or twisting of yoke 33 when the shaft 22 is rotated about its longitudinal axis. Two corresponding elongated helical tension springs 38 and 39, having hooked ends, are secured to yoke 33 as described above, and are also secured to the bottom ends of arms or cranks 21. More specifically, the hooked outer ends of the springs are hooked vertically around groove portions 41 formed at the bottoms of the arms 21 (FIG. 2).

In the illustrated preferred form, shaft 22 extends between the arms 21. This provides balance and symmetry of forces.

The apparatus is quickly and easily assembled. The bushings 24 and 25 are inserted into opposite ends of bore 13, following which shaft 22 is extended inwardly through the bushings so that its inner end is in the bottom of recess 12. The threaded yoke 33 is then mounted by holding it in the bottom of the recess and causing head 27 to penetrate therein, such head having a smaller diameter than the internally-threaded wall of central portion 34 of the yoke. Shaft 22 is then rotated, mechanically or manually, to quickly cause the yoke 33 to be threaded a substantial distance onto the shaft. Therefter, the shaft 22 is inserted further into the recess, until the head 27 abuts wall 23 which serves as a stop and locator.

Then, bracket 27 is mounted as described above, being held down by the screw 31. It is then merely necessary to hook the rear spring ends over the bottom portions of arms 21, and to hook the forward spring ends around screws 36. At this time, the knife elements 17 are in inserted positions in the grooves in pivot blocks 15.

A pickguard (not shown) is mounted on the upper surface of the guitar body, over the recess 12, to close the same. The guitar is strung in the usual manner, and spring-tension is adjusted by rotating the shaft 22 to thus shift yoke 33 therealong, in either direction, to increase or relax the tension on the tremolo springs 38 and 39.

The spring tension desired by the guitarist varies with the gauges of the guitar strings, and with other factors. Thus, when (for example) the strings are changed, the spring tension will be adjusted.

Figure 1:
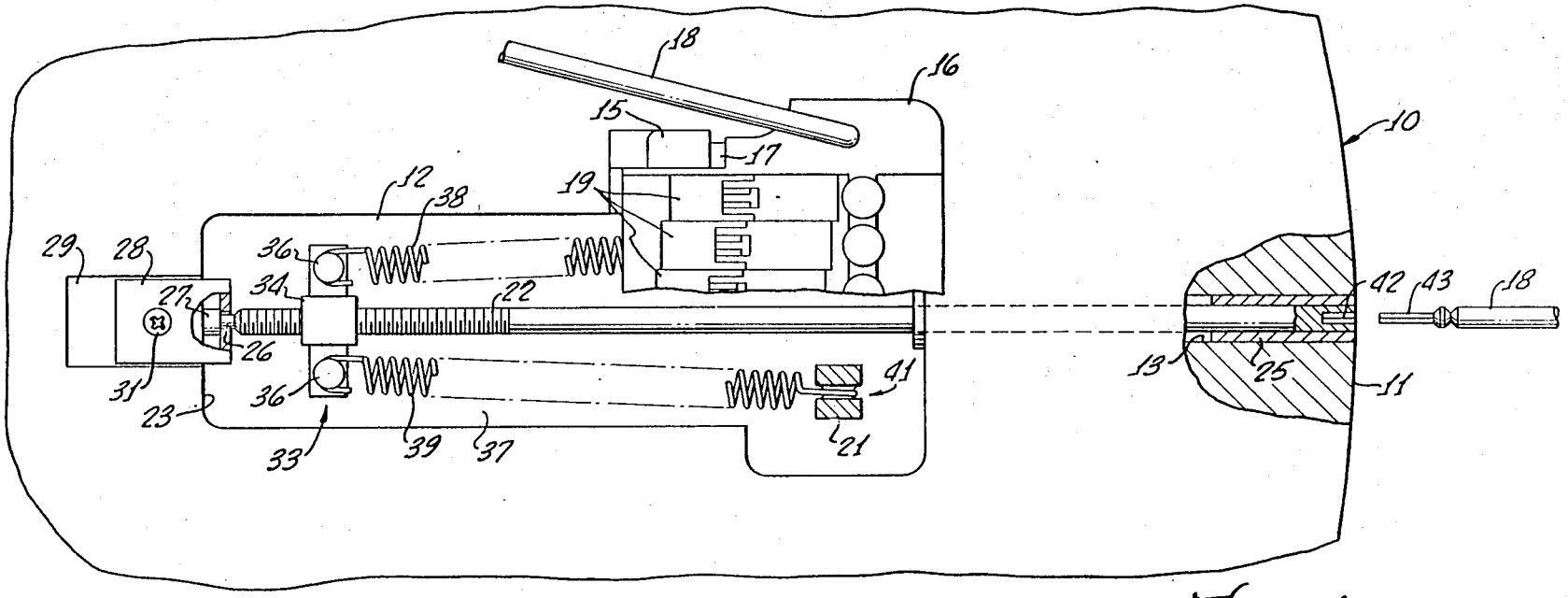
FIG. 1 is a top plan view of a tremolo mechanism incorporating the present invention.

Shaft rotation is preferably achieved by providing a hexagonal socket hole 42 in the outer end of the shaft. Such hole is adapted to receive a hexagonal wrench 43 as shown in FIG. 1. Very preferably, such wrench is on tremolo arm 18, extending axially of the lower portion (when the arm is in playing position) of the arm as shown at the right in FIG. 1. Such lower portion is the mounting-leg portion of the tremolo arm, and extends transversely from the handle portion of such arm.

The mounting-leg portion of arm 18 snaps into the bridge plate 16 as described in detail in the above-cited Page-Schaller U.S. Pat. No. 4,604,936. Such snap in action is not impeded by the axially-extending wrench 43, which merely projects below the connector mechanism (described in the Page and Schaller patent) when the tremolo arm is in the playing position shown in FIGS. 1 and 2 at the left thereof.

With the present apparatus, the guitarist may effect any desired degree of spring-tension adjustment even while the guitar is being supported by a shoulder strap from the musician's neck. The musician snaps the tremolo arm out of its socket, and employs the hex wrench that is built into such tremolo arm to "crank" the spring-tension to any desired extent. After the spring-tension is as desired, the tremolo arm is snapped back into the tremolo apparatus. Alternatively, a standard hex key may be employed.

It is pointed out that the bridge plate 16 and arms 21 cooperate with the fulcrum means to form a lever. This would be true even if the fulcrum means were not knife-edge but instead a shaft in bearings.

The shaft 22 is so adjusted that the lever is balanced, the string tension being compensated by the spring tension. Thus, the lever (bridge plate) floats, so that the plate may move in either direction in response to operation of arm 18.

The foregoing detailed description is to be clearly understood as given by way of illustration and example only, the spirit and scope of this invention being limited solely by the appended claims.

What is claimed is:

1. An electric guitar, comprising:

(a) a guitar body having a guitar neck projecting therefrom, said body having an access opening at the tail end thereof, (b) guitar strings anchored at the outer end of said neck, and extended over said neck and body, (c) pivot means mounted on said body, (d) a tremolo bridge-plate lever pivotally associated with said pivot means, said bridge-plate lever being connected to said strings, (e) a handle connected to said bridge-plate lever for operation by the guitarist to pivot said bridge-plate lever and thus provide a tremolo action, (f) elongated spring means disposed within said guitar body, (g) means to connect one end of said spring means to said bridge-plate lever, (h) a long, threaded shaft disposed in said guitar body generally longitudinally of said strings, said shaft passing beneath said bridge-plate lever, from the tail of said guitar body to a position far closer to the outer end of said neck than is said bridge-plate lever, (i) means in said body to mount said shaft for rotation about the longitudinal axis thereof, said shaft being so related to said access opening at the tail end of said body that said shaft may be rotated about said longitudinal axis by a means located at said access opening, and (j) means to connect said shaft to the other end of said spring means, said mounting means (i) and said connecting means (j) being so constructed and so related to each other that said rotation of said shaft about its longitudinal axis effects movement of said other end of said spring means generally longitudinally of said strings to thus effect a large amount of controlled variation in the force exerted by said spring means on said bridge-plate lever.

2. An electric guitar, comprising:

(a) a guitar body having a guitar neck projecting therefrom, (b) guitar strings anchored at the outer end of said neck, and extended over said neck and body, (c) pivot means mounted on said body, (d) a tremolo bridge-plate lever pivotally associated with said pivot means, said bridge-plate lever being connected to said strings, (e) a handle connected to said bridge-plate lever for operation by the guitarist to pivot said bridge-plate lever and thus provide a tremolo action, (f) elongated spring means disposed within said guitar body, (g) means to connect one end of said spring means to said bridge-plate lever, (h) a long, threaded shaft disposed in said guitar body generally longitudinally of said strings, said shaft passing beneath said bridge-plate lever, from the tail of said guitar body to a position far closer to the outer end of said neck than is said bridge-plate lever, (i) means to rotatably mount said shaft in said body for rotation about the longitudinal axis of said shaft, and in such manner that said shaft does not move longitudinally in said body in response to said rotation, (j) an internally-threaded element mounted on said shaft in said body and threadedly associated with said shaft, (k) means to connect said internally-threaded element to the other end of said spring means, whereby rotation of said shaft about the longitudinal axis thereof effects shifting of said internally-threaded element along said shaft to change the force on said spring means, and (l) access means provided in the tail of said body to permit the guitarist to effect rotation of said shaft about the longitudinal axis thereof.

3. An electric guitar, comprising:

(a) a guitar body having a relatively large recess in one side thereof, (b) a guitar neck projecting from one end of said body, (c) guitar strings anchored at the outer end of said neck and extended over said neck and body, (d) pivot means mounted on said body, (e) a tremolo lever pivotally associated with said pivot means, said tremolo lever being connected to said strings, (f) a handle connected to said lever for operation by the guitarist to pivot said lever and thus provide a tremolo action, (g) elongated spring means disposed within said recess in said guitar body, (h) means to connect one end of said spring means to said lever, (i) an elongated threaded shaft disposed in said recess and orientated generally longitudinally of said strings, (j) bore or passage means provided in said guitar body between said recess and the tail end of the guitar, said shaft and said bore or passage means being so related to each other that the musician may effect rotation of said shaft by performing a shaft-rotating action at the tail end of the guitar, (k) a spring-connector element mounted on said shaft in said recess, said shaft and said spring-connector element being so constructed, mounted and related that rotation of said shaft about the longitudinal axis thereof effects shifting of said spring-connector element generally longitudinally of said guitar body, and (l) means to connect the other end of said spring means to said spring-connector element, so that rotation of said shaft effects lessening or increasing of the force exerted by said spring means on said tremolo lever.

4. The invention as claimed in claim 3 in which a portion of said shaft extends into said bore or passage means.

5. The invention as claimed in claim 4, in which a portion of said shaft extends into said passage means sufficiently far that the outer end of said shaft is near the tail end of said guitar body.

6. The invention as claimed in claim 3, in which said shaft extends beneath said tremolo lever, from a position between said tremolo lever and said neck to a position farther from said neck than is said tremolo lever.

7. The invention as claimed in claim 3, in which bearing means are provided in said body to effect rotatable mounting of said shaft.

8. The invention as claimed in claim 7, in which said bearing means include thrust-bearing means to prevent shifting of said shaft longitudinally in response to rotation thereof.

9. The invention as claimed in claim 3, in which said shaft extends through at least a substantial portion of said bore or passage means and then extends into said recess in said guitar body, in which thrust-bearing means are provided to prevent shifting of said shaft in an axial direction in response to rotation of said shaft, and in which said spring-connector element is internally threaded and is threadedly associated with said shaft in said recess.

10. The invention as claimed in claim 9, in which said spring-connector element is a yoke or block extending outwardly in both directions from the internally-threaded portion thereof, in which said spring means comprise two helical tension springs stretched between opposite portions of said yoke and spaced-apart portions of said tremolo lever.

11. The invention as claimed in claim 10, in which said recess is so shaped that a wall thereof is adjacent said yoke or block, and thus prevents any tendency of said yoke or block to rotate or twist during rotation of said shaft.

12. The invention as claimed in claim 9 in which a head is provided at the inner end of said shaft, said head being separated from the remainder of said shaft by a small-diameter neck, in which said head has an outer diameter smaller than the diameter of the internally-threaded spring-connector element, in which a thrust-bearing means is provided and comprises an element having a forked end, the two prongs of which seat on both sides of said neck and cooperate with said head in providing a thrust-bearing action, said element being secured fixedly to said guitar body.

13. In combination with an electric guitar, a tension-adjustable tremolo apparatus comprising:

(a) spring means provided in the body of the guitar, (b) a tremolo lever pivotally mounted on said body, one end of said lever being connected to said spring means, the other end of said lever being connected to the strings of the guitar, (c) spring force-adjustment means provided in said guitar body to vary the force on said spring means, said means including a rotatable element and also including wrench-socket means accessible from the exterior of said guitar body, (d) a tremolo handle removably secured to said lever to effect pivoting of said lever to thus create a tremolo action, said tremolo handle having a handle portion, said tremolo handle further having a mounting-leg portion that extends transversely from said handle portion, and (e) a wrench provided on the end of said mounting-leg portion that is remote from said handle portion, said wrench being shaped to mate with said socket means recited in clause (c), whereby the guitarist may remove said handle from said lever, insert said wrench into said socket means, and employ said handle portion as a crank to rotate said mounting-leg portion and thus said rotatable element to vary the spring force of said spring means.

14. An electric guitar having a tremolo actuated by a combined handle and wrench, said guitar comprising:

(a) a guitar body and neck combination, (b) guitar strings mounted in tensioned relationship over said body and neck combination, (c) a tremolo apparatus pivotally mounted on the guitar body and so associated with said strings that pivoting of said apparatus about a predetermined horizontal axis creates a tremolo sounds when said strings are vibrating, said tremolo apparatus including spring means to maintain said apparatus in a neutral position except when said apparatus is being pivoted by the guitarist about said axis, (d) means on said tremolo apparatus to removably receive a combination tremolo handle and wrench, (e) a combination tremolo handle and wrench, said combination handle and wrench having an elongate handle portion adapted to be actuated by the guitarist to effect tremolo action, said combination handle and wrench further having a mounting-leg portion connected to said handle portion and extending transversely of said handle portion, said mounting-leg portion being adapted to be removably received in said means (d), said combination handle and wrench further having a wrench at an end portion thereof, and (f) guitar-hardware apparatus provided on said guitar body and neck combination, said guitar-hardware apparatus having a portion adapted to mate with said wrench, and be rotated thereby, after said combination handle and wrench has been removed from said means (d).

15. The invention as claimed in claim 14, in which said wrench is connected to said mounting-leg portion at the end portion thereof that is remote from said handle portion, said wrench being oriented generally axially of said mounting-leg portion and being adapted to be removably received in said means (d) when said mounting-leg portion is received therein, said handle portion being employed by the guitarist to crank said mounting-leg portion and thus rotate said wrench and guitar-hardware apparatus.

* * * * *